United States Patent [19]

Hardin et al.

[11] Patent Number: 5,024,506

[45] Date of Patent: Jun. 18, 1991

[54] PLENUM CABLES WHICH INCLUDE NON-HALOGENATED PLASTIC MATERIALS

[75] Inventors: Tommy G. Hardin, Lilburn, Ga.; Behrooz A. Khorramian, New York, N.Y.

[73] Assignee: AT&T Bell Laboratories, Murray Hill, N.J.

[21] Appl. No.: 449,229

[22] Filed: Dec. 21, 1989

Related U.S. Application Data

[63] Continuation-in-part of Ser. No. 303,212, Jan. 27, 1989, abandoned.

[51] Int. Cl.[5] ..... G02B 6/44

[52] U.S. Cl. ..... 350/96.23

[58] Field of Search ..... 350/96.20–96.23

[56] References Cited

U.S. PATENT DOCUMENTS

| | | | |
|---|---|---|---|
| 3,922,465 | 11/1975 | Kawaguchi et al. . | |
| 4,076,382 | 2/1978 | Oestreich | 350/96.23 |
| 4,284,842 | 8/1981 | Arroyo et al. | 174/107 |
| 4,514,036 | 4/1985 | McDonald | 350/96.23 |
| 4,575,184 | 3/1986 | Ueno et al. | 350/96.23 |
| 4,605,818 | 8/1986 | Arroyo et al. | 174/107 |
| 4,664,472 | 5/1987 | Mayr et al. | 350/96.23 |
| 4,826,899 | 5/1989 | Rees | 524/94 |
| 4,848,869 | 7/1989 | Urruti | 350/96.33 |

FOREIGN PATENT DOCUMENTS

| | | |
|---|---|---|
| 056510 | 7/1982 | European Pat. Off. . |
| 0197227 | 10/1986 | European Pat. Off. . |
| 0258036 | 8/1987 | European Pat. Off. . |
| 0268827 | 10/1987 | European Pat. Off. . |

OTHER PUBLICATIONS

Brochures by General Electric entitled, "Silicone Polyimide Copolymer Processing Conditions", Combustion Characteristics of ULTEM Resins, dated 1/7/87, Technical Marketing Bulletin—Extrusion Guidelines for ULTEM 1000 dated 4/10/82.

"481-XV-40 Silicone-Polyimide Copolymer"—Preliminary Silicone Product Info Brochure entitled, Smoke Density and Toxicity.

Publication by General Electric entitled, "ULTEM Resin Design Guide".

Article from *New Products* entitled, "Initial and Secondary Fire Damage Costs".

Article from *Telecommunication Journal* entitled, "Fire Precautions in Telephone Exchange", vol. 49, 1982, p. 223.

In *Interview* an interview with Hans de Munck entitled, "Developing Noryl Resin PX1766".

Article by S. Kaufman entitled, "Using Combustion Toxicity Data in Cable Selection", pp. 636–648, 1988, International Wire and Cable Sympsoium Proceedings (IWCS).

S. Kaufman's article entitled, "PVC in Communication Cable", published in the Journal of Vinyl Technology, Sep. '85, vol. 7, #3.

S. Kaufman's article in "The 1987 National Electrical Code Requirements for Cable", beginning at p. 545, IWCS 1986.

(List continue on next page.)

*Primary Examiner*—Akm Ullah

*Attorney, Agent, or Firm*—E. W. Somers

[57] ABSTRACT

A cable which may be used in buildings in concealed areas such as in plenums or in riser shafts includes a core (22) which includes at least one transmission medium which is enclosed with a non-halogenated plastic material. The core is enclosed with a jacket (28) which also is made of a non-halogenated plastic material. The non-halogenated plastic material of the insulation is selected from the group consisting of a polyetherimide and a silicone-polyimide copolymer, or a blend comprising the polyetherimide and the silicone-polyimide copolymer. For the jacket, the plastic material includes a silicone-polyimide copolymer.

8 Claims, 4 Drawing Sheets thermoplastic non-halogen flame retardant jacketing material.

General Electric's NORYL PX1766 undated brochure.

Fire and Flammability Bulletin, vol. 9, No. 7, dated. Feb. 1988.

AT&T Practice Standard Issue 3, Nov. 1987 entitled, "Fire Safety and Consideration of Cable in Buildings".

"Fire Testing of Riser Cables", by L. J. Przybyla appearing in vol. 3, Jan./Feb. '85, Issue of *Journal of Fire Sciences.*

"Flammability of Polymers: Test Methods", appears beginning at p. 1797 of the Encyclopedia of Materials Science and Engineering (1986).

Article by R. O. Johnson & H. S. Burlhis entitled, "Polyetherimide: A New High Performance Thermoplastic Resin", p. 129 of the Journal of Polymer Science: Polymer Symposium 70, 129-143 (1983).

S. Kaufman et al., "A Test Method for Measuring and Classifying the Flame Spreading and Smoke Generating Characteristics of Communications Cable".

S. Kaufman, "The 1987 National Electrical Code Requirements for Optical Fiber Cable".

"Cable Catastrophes", The Sentinel, Jul.-Aug. 1979.

S. Artingstall et al., "Recent Advances in Thermoplastic, Zero Halogen, Low Smoke Fire Retardant Cable Compound Technology", International Wire and Cable Symposium, Nov. 17 thru 19, 1987.

"Norway's PTT Forces Halogen-free Alternative in Cable Covering", Tender by Telecom Australia dated 9/3/85.

"Extrusion of Noryl resin PX1766 in the Wire Insulation Process", *Extrusion,* Allianz Versicherungs-AG Technische Information (1980).

Brochure of the Union Carbide Corporation discloses

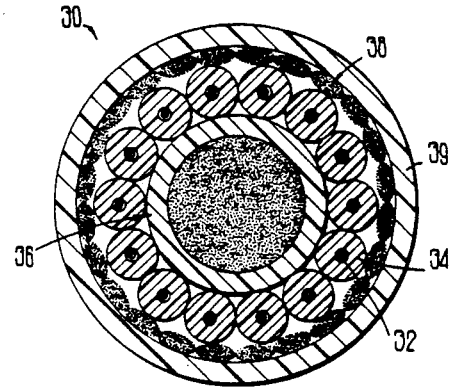

PLENUM CABLES WHICH INCLUDE NON-HALOGENATED PLASTIC MATERIALS

CROSS-REFERENCE TO RELATED APPLICATION

This application is a continuation-in-part application of application Ser. No. 07/303,212 which was filed on Jan. 27, 1989 in the names of T.G. Hardin and B.A. Khorramian as a new application now abandoned.

TECHNICAL FIELD

This invention relates to plenum cables which include non-halogenated plastic materials. More particularly, the invention relate to communications cables such as plenum cables which are used in buildings and which include non-halogenated insulation and jacketing materials that exhibit flame spread and smoke generation properties, which are acceptable by industry standards, as well as an acceptable toxicity level and relatively low corrosivity.

BACKGROUND OF THE INVENTION

In the construction of many buildings, a finished ceiling, which is referred to as a drop ceiling, is spaced below a structural floor panel that is constructed of concrete, for example. Light fixtures as well as other items appear below the drop ceiling. The space between the ceiling and the structural floor from which it is suspended serves as a return-air plenum for elements of heating and cooling systems as well as a convenient location for the installation of communications cables including those for computers and alarm systems. The latter includes communications, data and signal cables for use in telephone, computer, control, alarm and related systems. It is not uncommon for these plenums to be continuous throughout the length and width of each floor. Also, the space under a raised floor in a computer room is considered a plenum if it is connected to a duct or to a plenum.

When a fire occurs in an area between a floor and a drop ceiling, it may be contained by walls and other building elements which enclose that area. However, if and when the fire reaches the plenum, and if flammable material occupies the plenum, the fire can spread quickly throughout an entire story of the building. The fire could travel along the length of cables which are installed in the plenum if the cables are not rated for plenum use. Also, smoke can be conveyed through the plenum to adjacent areas and to other stories.

A non-plenum rated cable sheath system which encloses a core of insulated copper conductors and which comprises only a conventional plastic jacket may not exhibit acceptable flame spread and smoke evolution properties. As the temperature in such a cable rises, charring of the jacket material begins. Afterwards, conductor insulation inside the jacket begins to decompose and char. If the jacket char retains its integrity, it functions to insulate the core; if not, it ruptures either by expanding insulation char, or by the pressure of gases generated from the insulation exposed to elevated temperature exposing the virgin interior of the jacket and insulation to elevated temperatures. The jacket and the insulation begin to pyrolize and emit more flammable gases. These gases ignite and, because of air drafts within the plenum, burn beyond the area of flame impingement, propagating flame and generating smoke and possibly toxic and corrosive gases.

As a general rule, the National Electrical Code (NEC) requires that power-limited cables in plenums be enclosed in metal conduits. The initial cost of metal conduits for communications cables in plenums is relatively expensive. Also, conduit is relatively inflexible and difficult to maneuver in plenums. Further, care must be taken during installation to guard against possible electrical shock which may be caused by the conduit engaging any exposed electrical service wires or equipment. However, the NEC permits certain exceptions to this requirement provided that such cables are tested and approved by an independent testing agent such as the Underwriters Laboratories (UL) as having suitably low flame spread and smoke-producing characteristics. The flame spread and smoke production of cable are measured using UL 910, Standard Test Method for fire and Smoke characteristics of Electrical and Optical-Fiber Cables Used in Air-Handling Handling Spaces. See S. Kaufman "The 1987 National Electric Code Requirements for Cable " which appeared in the 1986 International Wire and Cable Symposium Proceedings beginning at page 545.

One prior art plenum cable which includes a core of copper conductors is shown in U.S. Pat. No. 4,284,842 which issued on Aug. 18, 1981 in the names of C.J. Arroyo, N.J. Cogelia and R.J. Darsey. The core is enclosed in a thermal core wrap material, a corrugated metallic barrier and two helically wrapped translucent tapes. The foregoing sheath system, which depends on its reflection characteristics to keep heat away from the core, is especially well suited to larger size copper plenum cables.

The prior art has addressed the problem of cable jackets that contribute to flame spread and smoke evolution also through the use of fluropolymers. These together with layers of other materials, have been used to control char development, jacket integrity and air permeability to minimize restrictions on choices of materials for insulation within the core. Commercially available fluorine-containing polymer materials have been accepted as the primary insulative covering for conductors and as a jacketing material for plenum cable without the use of metal conduit. In one prior art small size plenum cable, disclosed in application Ser. No. 626,085 filed Jun. 29, 1984 in the names of C.J. Arroyo, et al. and now U.S. Pat. No. 4,605,818, a sheath system includes a layer of a woven material which is impregnated with a flurocarbon resin and which encloses a core. The woven layer has an air permeability which is sufficiently low to minimize gaseous flow through the woven layer and to delay heat transfer to the core. An outer jacket of an extrudable fluoropolymer material encloses the layer of woven material. In the last-described cable design, a substantial quantity of fluorine, which is a halogen, is used. Fluoropolymer materials are somewhat difficult to process. Also, some of those Fluorine-containing materials have a relatively high dielectric constant which makes them unattractive as insulation for communications conductors.

The problem of acceptable plenum cable design is complicated somewhat by a trend to the extension of the use of optical fiber transmission media for a loop to building distribution systems. Not only must the optical fiber be protected from transmission degradation, but also it has properties which differ significantly from those of copper conductors and hence requires special treatment. Light transmitting optical fibers are mechanically fragile, exhibiting low strain fracture under tensile loading and degraded light transmission when bent with a relatively low radius of curvature. The degradation in transmission which results from bending is known as microbending loss. This loss can occur because of coupling between the jacket and the core. Coupling may result because of shrinkage during cooling of the jacket and because of differential thermal contractions when the thermal properties of the jacket material differ significantly from those of the enclosed optical fibers.

The use of fluoropolymers for optical fiber plenum cable jackets requires special consideration of material properties such as crystallinity, and coupling between the jacket and an optical fiber core which can have detrimental effects on the optical fibers. If the jacket is coupled to the optical fiber core, the shrinkage of fluropolymer plastic material, which is semi-crystalline, following extrusion puts the optical fiber in compression and results in microbending losses in the fiber. Further, its thermal expansion coefficients relative to glass are large, thereby compromising the stability of optical performance over varying thermal operation conditions. Also, the use of fluoropolymers adds excessively to the cost of the cables at today's prices, and requires special care for processing.

Further, a fluoropolymer is a halogenated material. Although there exist cables which include halogen materials and which have passed the UL 910 test requirements, there has been a desire to overcome some problems which still exist with respect to the use of halogenated materials such as fluoropolymers and polyvinyl chloride (PVC). These materials exhibit undesired levels of corrosion. If a fluoropolymer is used, hydrogen fluoride forms under the influence of heat, causing corrosion. For a PVC, hydrogen chloride is formed.

Generally, there are a number of halogenated materials which pass the industry tests. However, if halogenated materials exhibit some less than desired characteristics as required by industry standards in the United States, it is logical to inquire as to why non-halogenated materials have not been used for cable materials. The prior art has treated non-halogenated materials as unacceptable because, as a general rule, they are not as flame retardant or because they are too inflexible if they are flame retardant. Materials for use in communications cables must be such that the resulting cables passes an industry standard test. For example, for plenum cable, such a test is the UL 910 test. The UL 910 test is conducted in apparatus which is known as the Steiner Tunnel. Many non-halogenated plastic materials have not passed this test. Non-halogenated materials have been used in countries outside the United States. One example of a non-halogenated material that has been offered as a material for insulating conductors is a polyphenylene oxide plastic material. Inasmuch as this material has not passed sucessfully industry standard tests in the United States for plenum use, ongoing efforts have heen in motion to provide a non-halogenated material which has a broad range of acceptable properties, as well as a reasonable price and yet one which passes the UL 910 test for plenum cables. Such a cable should be one which appeals to a broad spectrum of customers.

The sought-after cable not only exhibits suitably low flame spread and low smoke producing characteristics provided by currently used cables which include halogenated materials but also one which meets a broad range of desired properties such as acceptable levels of corrosivity and toxicity. Such a cable does not appear to be available in the prior art. Quite succinctly, the challenge is to provide a halogen-free cable which meets the standards in the United States for plenum cables. What is further sought is a cable which is characterized as having relatively low corrosive properties, and acceptable toxic properties as well as low levels of smoke generation and one which is readily processable at reasonable costs.

SUMMARY OF THE INVENTION

The foregoing problems of the prior art have been overcome with the cables of this invention. A cable of this invention comprises a core which includes at least one transmission medium. For communications use, the transmission medium may include optical fiber or metallic conductors. Each transmission medium is enclosed with a non-halogenated plastic material selected from the group consisting of a polyetherimide, a silicone-polyimide copolymer or blends of these two materials. A jacket encloses the core and is made of a non-halogenated plastic material which includes a silicone-polyimide copolymer constituent. The jacket may comprise as much as 100% by weight of the silicone-polyimide copolymer constituent.

In one embodiment, the cable also includes a laminated metallic shield. The laminate comprises a metallic material and a non-halogenated material which may be a polyetherimide, a silicone-polyimide copolymer or blends of these two plastic materials.

Advantageously, the cables of this invention may be used in building plenums and/or risers. They are acceptable by UL 910 test requirements for flame spread and smoke generation. Further, they exhibit acceptable levels of toxicity and relatively low corrosivity.

BRIEF DESCRIPTION OF THE DRAWING

Other features of the present invention will be more readily understood from the following detailed description of specific embodiments thereof when read in conjunction with the accompanying drawings, in which.

DETAILED DESCRIPTION

Figure 1:
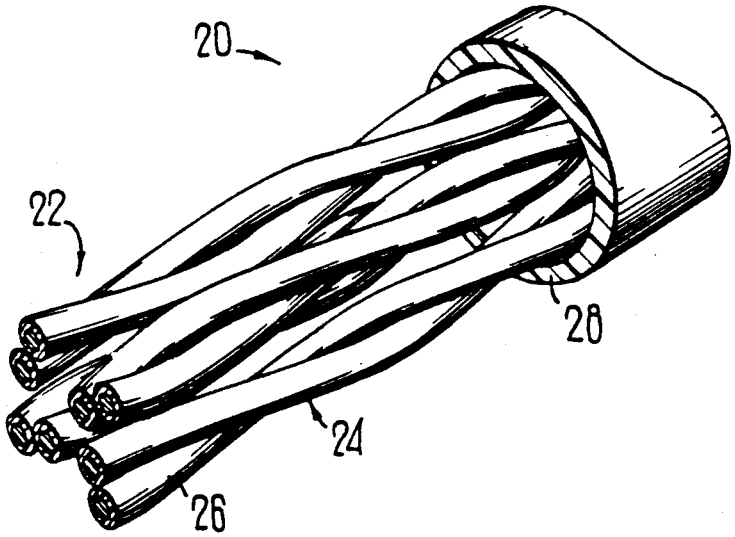
FIG. 1 is a perspective view of a cable of this invention.
Figure 2:
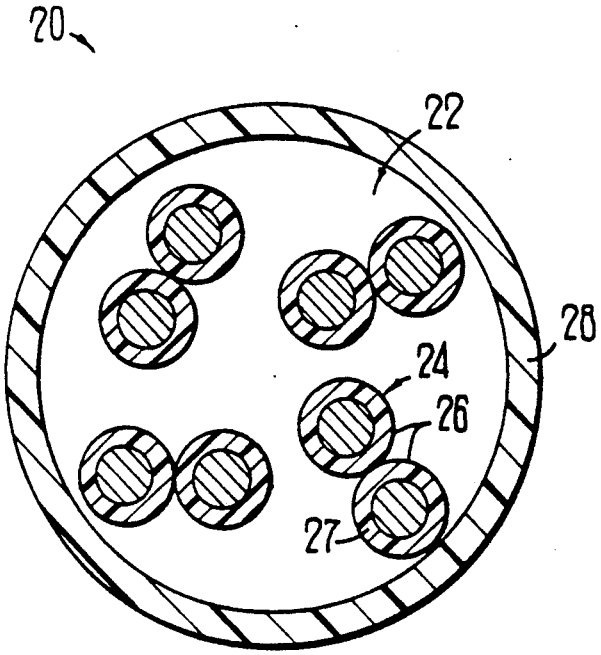
FIG. 2 is an end cross-sectional view of the cable of FIG. 1 with spacing among pairs of conductors being exaggerated.
Figure 3:
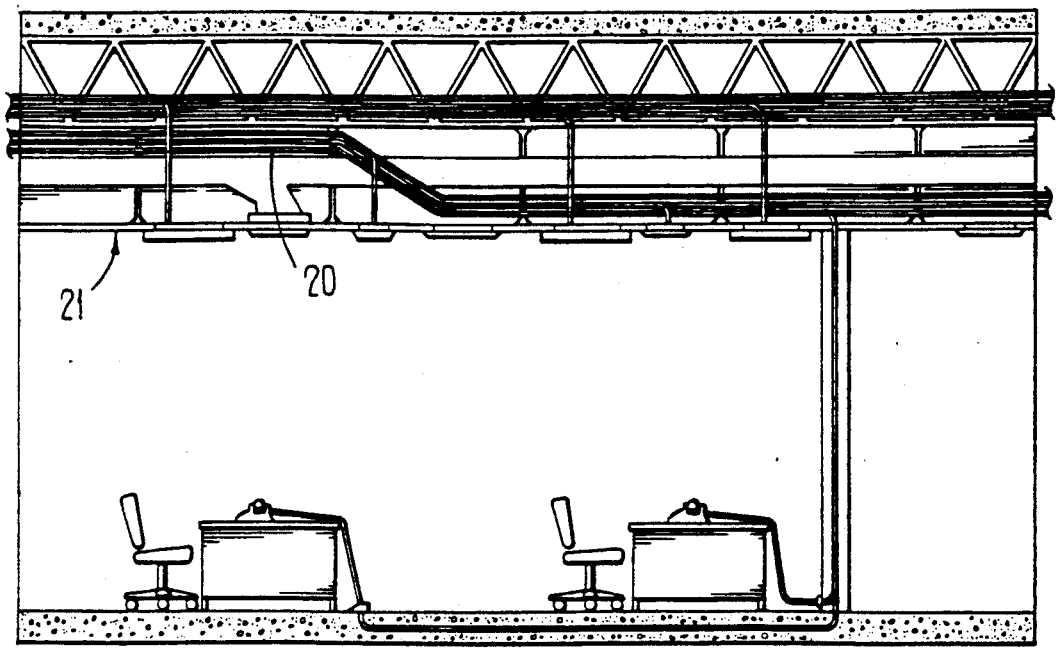
FIG. 3 is an elevational view of a portion of a building which includes a plenum, depicting the use of cables of this invention.

Referring now to FIGS. 1 and 2 there is shown a cable which is designated generally by the numeral 20 and which is capable of being used in buildings in plenums. A typical building plenum 21 is depicted in FIG. 3. There a cable 20 of this invention is disposed in the plenum. As can be seen, the cable 20 includes a core 22 which comprises at least one transmission medium. The transmission medium may comprise metallic insulated conductors or optical fiber. The core 22 may be enclosed by a core wrap (not shown). The core 22 may be one which is suitable for use in data, computer, alarm and signaling networks as well as in voice communication.

For purposes of the description hereinafter, the transmission medium comprises twisted pairs 24—24 of insulated metallic conductors 26—26. Although some cables which are used in plenums may include twenty-five or more conductor pairs, many such cables include as few as six, four, two or even single conductor pairs.

In order to provide the cable 20 with flame retardancy, low corrosivity, acceptable toxicity and low smoke generation properties, the metallic conductors are provided with an insulation 27 comprising a plastic material which provides those properties. The metallic conductors each may be provided with an insulation cover comprising a polyetherimide. Polyetherimide is an amorphous thermoplastic resin which is available commerically, for example, from the General Electric Company under the designation ULTEM ® resin. The resin is characterized by high deflection temperature of 200° C. at 264 psi, a relatively high tensile strength and flexural modulus and very good retention of mechanical properties at elevated temperatures. It inherently is flame resistant without the use of other constituents and has a limiting oxygen index of 47.

Polyetherimide is a polyimide having other linkages incorporated into the polyimide molecular chain to provide sufficient flexibility to allow suitable melt processability. It retains the aromatic imide characteristics of excellent mechanical and thermal properties. Polyetherimide is described in an article authored by R.O. Johnson and H.S. Burlhis entitled "Polyetherimide: A New High-Performance Thermoplastic Resin" which appeared beginning at page 129 in the 1983 Journal of Polymer Science.

It should be noted that the insulation 27 may comprise materials other than the polyetherimide. For example, the insulation may be a composition comprising a silicone-polyimide copolymer or a composition comprising a blend of a polyetherimide and a silicone-polyimide copolymer. Silicone-polyimide copolymer is a flame-resistant non-halogen containing thermoplastic material. A suitable silicone material is a silicone-polyetherimide copolymer which is a copolymer of siloxane and etherimide. One such material is designated SILTEM TM copolymer and is available commerically from the General Electric Company. The polyetherimide of the blend composition ranges from about 0% to about 100% by weight of the composition, and the silicone-polyimide copolymer ranges from about 0% to about 100% by weight of the composition.

About the core is disposed a jacket 28. The jacket 28 is comprised of a plastic material, which includes a silicone-polyimide copolymer constituent which may also be used as the insulation cover for the metallic conductors. The jacket 28 also may include as much as 100% of the silicone-polyimide copolymer or it may comprise a blend composition comprising a silicone-polyimide copolymer and a polyetherimide.

Additionally, for the jacket, a flame retardant, smoke suppression system in the range of about 0 to 20% by weight may be added to any of the singular materials or blends. Among those systems which enhance flame retardancy and smoke suppression are inorganic compounds such as metallic oxide and titanium dioxide, for example, and metal salts such as zinc borate, for example.

In the past, the cable industry in the United States has shied away from non-halogenated materials for use in plenum cables. These non-halogenated materials which possess desired properties seemingly were too inflexible to be used in such a product whereas those non-halogenated materials which had the desired amount of flexibility did not meet the higher United States standards for plenum cable. What is surprising is that the transmission medium covers and jacket of the cable of this invention include non-halogenated materials and yet the cable meets UL 910 test requirements.

Figure 4:
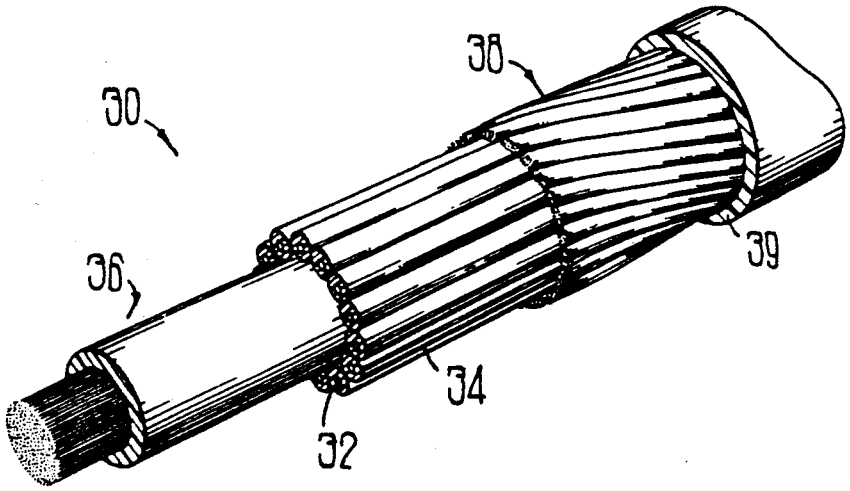
FIGS. 4 and 5 are perspective and end views of an optical fiber cable of this invention.
Figure 5:
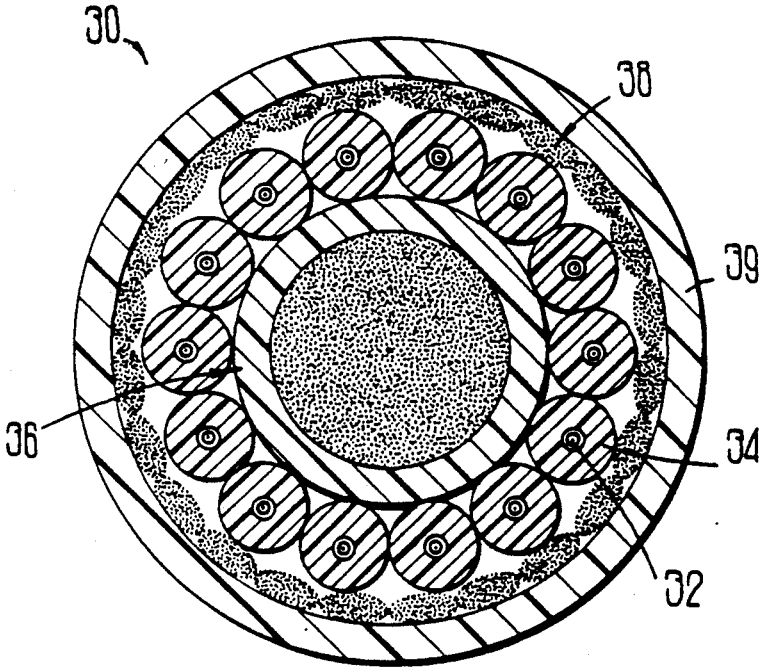

For optical fiber cables in which optical fibers are provided with a buffer layer, a silicone-polyimide copolymer is preferred as the material for the buffer layer. The silicone-polyimide copolymer has a low modulus than the polyetherimide which reduces the possibility of inducing microbending loss into the optical fibers. A typical fiber plenum cable 30 is shown in FIGS. 4 and 5. The cable 30 includes a plurality of coated optical fibers 32—32 each covered with a buffer layer 34. As is seen, the plurality of optical fibers is disposed about a central organizer 36 and enclosed in a layer 38 of a strength material such as KEVLAR ® yarn. The strength member layer is enclosed in a jacket 39 which is a non-halogenated material which includes a silicone-polyimide copolymer constituent. The jacket may comprise a blend of a polyetherimide and a silicone-polyimide copolymer.

Surprisingly, the cable of this invention which includes non-halogenated insulation and jacketing materials not only meets acceptable industry standards for flame spread and smoke generation properties, but also it has relatively low corrosivity and an acceptable level of toxicity. The result is surprising and unexpected because it has been thought that non-halogented materials which would have acceptable levels of flame spread and smoke generation were excessively rigid and that those which had suitable flexibility would not provide suitable flame spread and smoke generation properties to satisfy industry standards. The conductor insulation and the jacketing material of the claimed cable cooperate to provide a system which delays the transfer of heat to the transmission members. Because conductive heat transfer, which decomposes conductor insulation, is delayed, smoke emission and further flame spread are controlled.

Flame spread and smoke evolution characteristics of cable may be demonstrated by using a well known Steiner Tunnel test in accordance with ASTM E-84 as modified for communications cables and now referred to as the UL 910 test. The UL 910 test is descrbed in the previously identified article by S. Kaufman and is a test method for determining the relative flame propagation and smoke generating characteristics of cable to be installed in ducts, plenums, and other spaces used for environmental air. Tests have shown that heat is transferred to the cable core 22 principally by thermal radiation, secondly by conduction and finally by convection.

During the Steiner Tunnel test, flame spread is observed for a predetermined time and smoke is measured by a photocell in an exhaust duct. For a cable to be rated as plenum, i.e. type CMP, according to the National Electric Code, flame spread must not exceed five feet. A measure of smoke evolution is termed optical density which is an obscuration measurement over a length of time as seen by an optical detector. The lower the optical density, the lower and hence the more desirable is the smoke characteristic. A cable designated CMP must have a maximum smoke density which is 0.5 or less and an average smoke density which is 0.15 or less.

Toxicity generating characteristics of cable may be demonstrated by a toxicity test developed by the University of Pittsburgh. In this test, a parameter referred to as $LC_{50}$ which is the lethal concentration of gases generated from the burning of a material which causes a 50% mortality among an animal population, that is, 2 out of 4 mice, for example, is mesured. $LC_{50}$ is an indication of the toxicity of a material caused by the smoke generated by its burning. The hight the value of the $LC_{50}$, the lower the toxicity. The higher the $LC_{50}$ value, the more material that must be burned to kill the same number of test animals. It is important to recognize that $LC_{50}$ is measured for the plastic material used in the cable without the metallic conductors. The $LC_{50}$ values for cables of this invention were higher than those for comparable cables which includes halogenated materials.

Low corrosion characteristics of the cables may be demonstrated by the measurement of the acid gases generated from the burning of the cable. The higher the percent acid gas generated, the more corrosive is the plastic material which encloses the transmission media. This procedure is currently used in a United States government military specification for shipboard cables. According to this specification, 2% acid gas, as measured in terms of percent hydrogen cloride generated per weight of cable, is the maximum allowed. Plenum cables of this invention showed 0% generation of acid gas.

The results for example cables of this invention as well as for similar plenum cables having halogenated materials for insulation and jacketing are shown in TABLE I hereinafter. Being plenum rated, the cables of TABLE I pass the UL 910 test for flame spread and smoke generation.

Example cables were subjected to tests in a Steiner Tunnel in accordance with the priorly mentioned UL 910 test and exposed to temperatures of 904° C., or incident heat fluxes as high as 63 kw/m$^2$.

TABLE I

| PLENUM CABLE | HALO-GENATED | | NON HALO-GENATED |
|---|---|---|---|
| EXAMPLE | 1 | 2 | 3 |
| PROPERTY | | | |
| A. Smoke generation | | | |
| max optical density | 0.276 | 0.300 | 0.482 |
| avg. optical density | 0.112 | 0.057 | 0.054 |
| B. Corrosivity % acid-gas generation | 42.20 | 30.79 | 0 |
| C. $LC_{50}$ (grams) | 25 ± 7 | 12 ± 2 | 40 ± 5 |
| D. Outside Diameter (inch) | 0.139 | 0.140 | 0.152 |
| E. Jacket thickness (inch) | 0.010 | 0.012 | 0.016 |

Each of the cables is TABLE I included four pairs of 24 gauge copper conductors each having a 0.006 inch thick insulation cover. The insulation and jacket of Example Nos. 1 and 2 comprised a fluoropolymer. The insulation and the jacket of cable of Example 3 were comprised of non-halogenated plastic materials. For Example No. 3, the unsulation and jacket each comprised a blend comprising 50% by weight of ULTEM ® resin and 50% of SILTEM TM copolymer.

Also, it has been found that a cable having a jacket which comprises 100% by weight of SILTEM TM copolymer passed the UL 910 test for flame spread and smoke generation. One example blend used to jacket a cable which passed the UL 910 test included about 15%, by weight of titanium dioxide and about 85% by weight of SILTEM TM copolymer. In another example, the blend included about 14% by weight of ULTEM ® resin, about 7% by weight of titanium dioxide and about 79% by weight of SILTEM TM copolymer.

Figure 6:
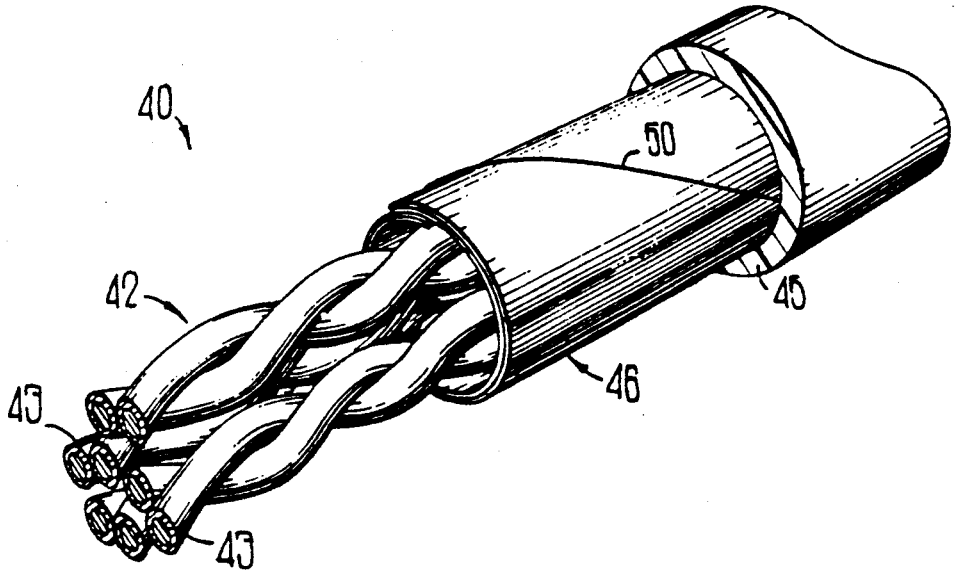
FIGS. 6 and 7 are perspective and end cross-sectional views of an alternate embodiment of a cable of this invention with spacing among pairs of conductors being exaggerated.
Figure 7:
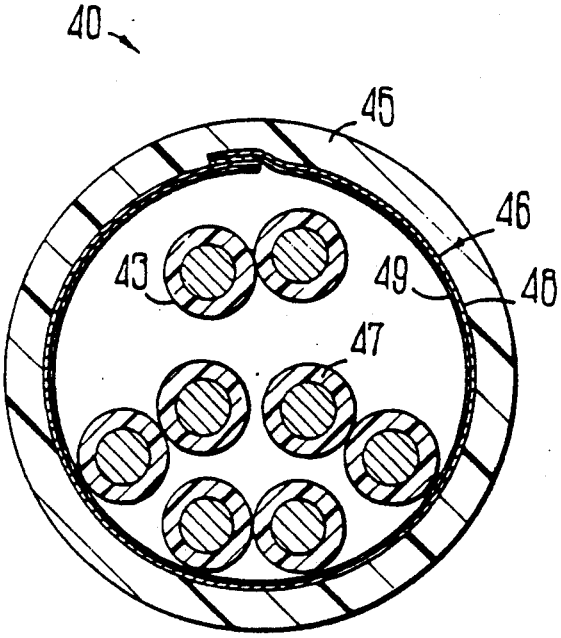

In another embodiment, a cable 40 (see FIG. 6 and 7) includes a core 42 which comprises transmission media such as twisted pairs of metaillic conductors 43–43, or of optical fiber, and a jacket 45. Interposed between the core 42 and the jacket is a laminated metallic shield 46 with or without a core wrap (not shown). Each of the conductors 43—43 is provided with an insulation cover 47 which comprises a polyetherimide, a silicon-polyimide compolymer or blends thereof with each consituent of the blend composition ranging from about 0% to 100% by weight. The jacket 45 comprises a silicone-polyimide copoloymer or a blend of a polyetherimide and a silicone-polyimide copolymer.

Figure 8:
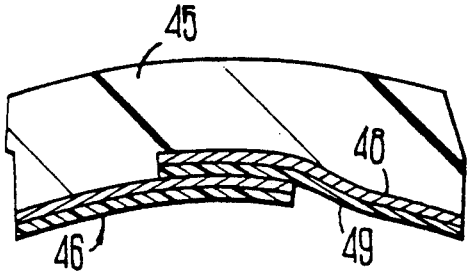
FIG. 8 is a detail view of a portion of the cable of FIGS. 6 and 7.

The shield 46 preferably is a laminate which includes a metallic layer 48 (see FIG. 8) and a film 49 which is adhered to the metallic layer. The film comprises plastic material such as a polyetherimide, a silicone-polyimide copolymer or a blend of polyetherimide and silicone-polyimide copolymer. In the blend, the polyetherimide may range from about 0% to 100% by weight of the blend consituents. In a preferred embodiment, the thickness of each of the new layers of the laminates is 0.001 inch.

It is important that the shield remain wrapped about the core. This is accomplished by wrapping a binder ribbon 50 about the shield after the shield has been wrapped about the core.

The cables of this invention include transmission media covers and jackets which have a range of thickness. But in each case, the cable passes the flame retardancy and smoke characteristics tests which are required today by the UL 910 test as well as provide relatively low corrosivity and acceptable toxicity.

The sheath system 30 of this invention (a) delays the transfer of conducted heat to the core 22 which produces less insulation deterioration which in turn produces less smoke and therefore less flame spread; (b) effectively reflects the radiant energy present throughout the length of the UL 910 test; (c) eliminates premature ignition at the overlapped seams; and (d) allows the insulation to char fully thereby blocking convective pyrolytic gas flow along the cable length. Further, it provides relatively low corrosivity and acceptable levels of toxicity.

It is to be understood that the above-described arrangements are simply illustrative of the invention. Other arrangements may be devised by those skilled in the art which will embody the principles of the invention and fall within the spirit and scope thereof.

We claim:

1. A communications cable, which comprises:

a core which comprises at least one communications transmission medium, said communications transmission medium being enclosed with a plastic material which is selected from the group consisting of a polyetherimide, a silicone-polyimide copolymer, and compositions which include a polyetherimide and a silicone-polyimide copolymer; and a jacket which encloses said core and which comprises a plastic material comprising a silicone-polyimide copolymer.

2. The cable of claim 1, wherein said jacket is a composition which may comprise as much as 100% by weight of a silicone-polyimide copolymer.

3. The cable of claim 2, wherein said jacket is a composition which comprises 100% by weight of a silicone-polyimide copolymer.

4. The cable of claim 1, wherein said jacket is a composition which comprises a polyetherimide and a silicone-polyimide copolymer.

5. The cable of claim 1, which also includes a core wrap which is disposed between said core and said jacket.

6. The cable of claim 1, which also includes a metallic shield, said metallic shield being disposed between said core and said jacket.

7. The cable of claim 6, wherein said shield comprises a laminate comprising a metallic material and a film material which is selected from the group consisting of a polyetherimide and a silicone-polyimide copolymer, and a blend composition of a polyetherimide and a silicone-polyimide copolymer.

8. The cable of claim 1, wherein said core comprises at least one optical fiber and said plastic material which encloses said optical fiber is a buffer layer comprising a silicone-polyimide copolymer.

* * * * *